United States Patent [19]

Ziegelmeyer

[11] 4,183,321

[45] Jan. 15, 1980

[54] GLUING MECHANISM FOR FINGER SLOTTING MACHINES

[76] Inventor: Harold R. Ziegelmeyer, 5010 Griffin Creek Rd., Medford, Oreg. 97501

[21] Appl. No.: 887,355

[22] Filed: Mar. 16, 1978

[51] Int. Cl.[2] ..... B05C 1/02

[52] U.S. Cl. ..... 118/259; 118/DIG. 9; 118/DIG. 15

[58] Field of Search ..... 118/258, 259, DIG. 15, 118/DIG. 9, 410, 411, 216, 225; 144/2 R, 315 R

[56] References Cited

U.S. PATENT DOCUMENTS

| | | | |
|---|---|---|---|
| 3,135,006 | 6/1964 | Leland | 118/259 X |
| 3,905,329 | 9/1975 | Cone et al. | 118/411 X |
| 3,946,700 | 3/1976 | Cromeens | 118/259 |

*Primary Examiner*—John P. McIntosh
*Attorney, Agent, or Firm*—Clarence M. Crews

[57] ABSTRACT

In a finger slotting and glue applying machine, random length studs, free from blemishes and having precisely squared ends, are advanced edgewise on a conveyor with their right ends (as viewed from the delivery end of the conveyor) aligned, past a set of slotting saws for uniformly slotting the right ends of the studs. The studs are then shifted to align their left ends and advanced past a second set of slotting saws for uniformly slotting the left ends of the studs. The studs then have adhesive applied in the left end slots and are then discharged at the introductory end of a machine which advances the studs lengthwise, interfitting and adhesively uniting successive studs end to end for producing blemish-free composite studs or beams which may be cut into any chosen length or lengths. The present invention has to do with limiting the regulating, the feeding and application of the glue to the slotted left ends of the studs and with the clean recovery and return to the source of surplus glue.

2 Claims, 7 Drawing Figures

GLUING MECHANISM FOR FINGER SLOTTING MACHINES

In finger slotting and glue applying machines it has been the usual practice to provide a glue pot, glue feeding means, and a glue applicator roller having alternate circumferential ribs and slots, so dimensioned that the glue applying ribs of the applicator roller interfit with the grooves in the slotted left hand end of each stud and deliver an abundance, and frequently a super-abundance, of glue into the slots.

Some of the surplus glue dripped off of the applicator roller, was collected in an open trough, and was returned to the glue pot for recirculation. This has had two serious drawbacks:

1. The glue became polluted by picking up sawdust from sawdust-laden air; and

2. The returned glue was progressively dried out and detrimentally changed in character by exposure to the air.

In accordance with the present invention these drawbacks are overcome (a) by providing a settable valve in the glue supply line which may be adjusted to control the rate of glue supply to the applicator roller to exceed by no more than a very small amount the actual glue requirements, and (b) by providing an enclosed line for returning the surplus glue, reduced in quantity, and protected against exposure to the atmosphere, to the glue pot.

As the applicator becomes worn, it tends to deliver a progressively increased excess of glue, but this can be correctively regulated by adjustment of the valve setting.

Other objects and advantages will hereinafter appear.

In the drawing forming part of this specification,

A finger slotting and glue applying machine 10, mounted on a fixed support 12, is shown only in a general way apart from the glue applying feature because its construction apart from the glue applying feature is conventional, is well understood, and is not altered in any way.

Figure 1:
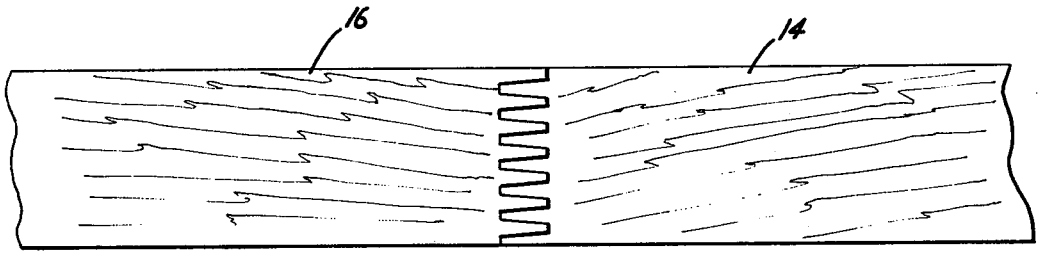
FIG. 1 is a fragmentary view, as seen from the side of two stud segments joined end to end.
Figure 2:
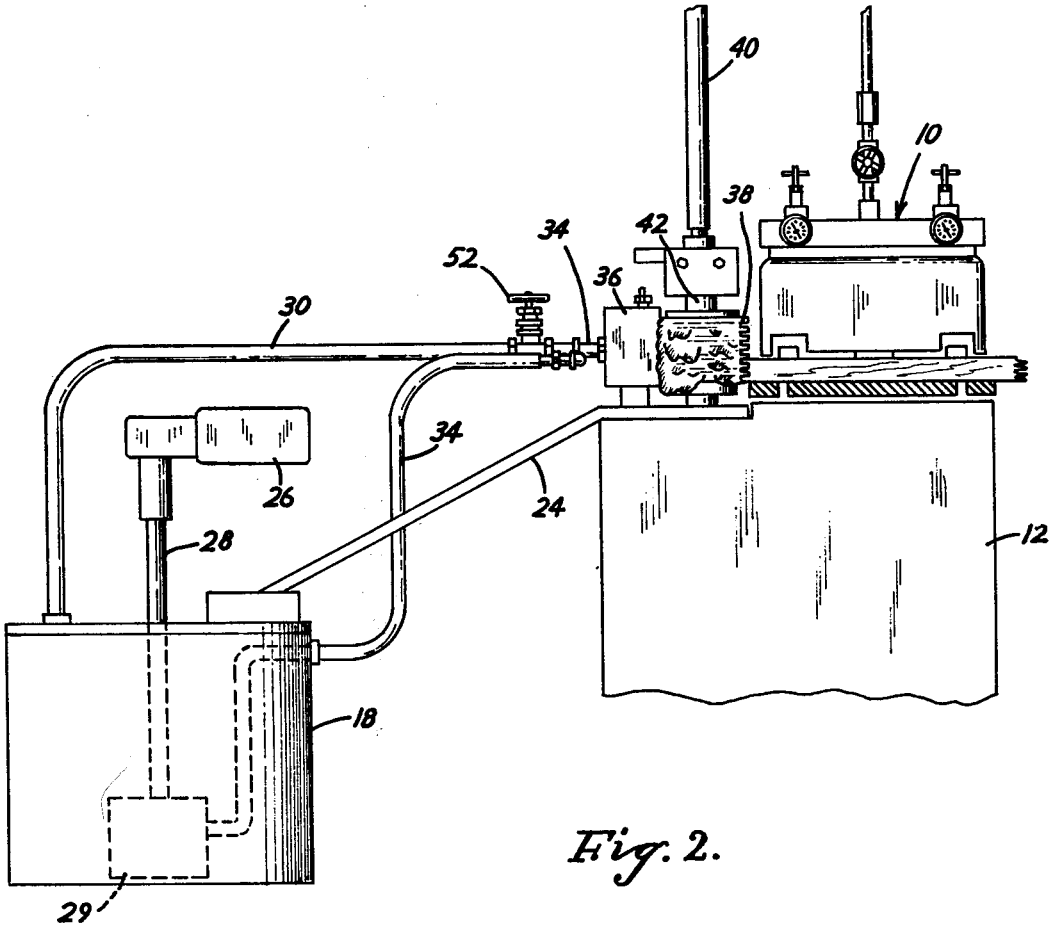
FIG. 2 is a view in end elevation of a stud slotting machine together with a glue applicator, a glue pot, means for regulating delivery of glue to the applicator and then to the work pieces, and means for returning surplus delivered glue to the glue pot.
Figure 3:
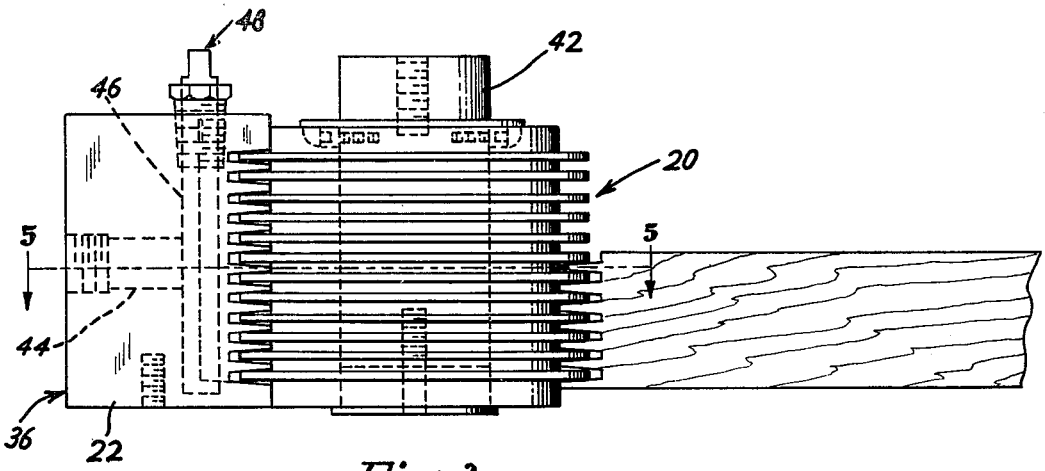
FIG. 3 is a view in elevation, on a considerably larger scale then FIG. 2, of the glue applicator, a settable glue supply regulator associated therewith, and a fragment of a stud to which glue is being applied.
Figure 4:
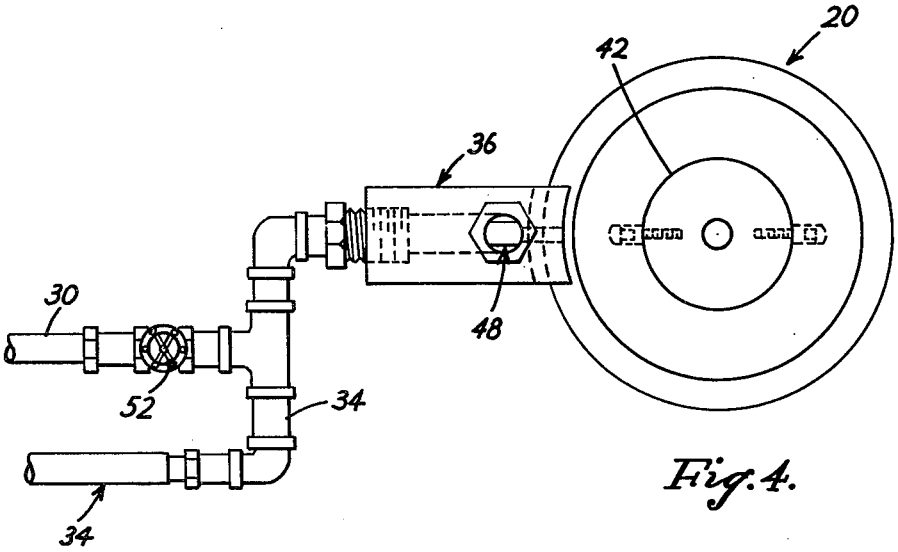
FIG. 4 is a plan view of the mechanism illustrated in FIG. 3 together with glue supplying and return pipes.

Studs 14 and 16 are fed sidewise in succession through the machine, each stud being first formed with tongues and slots at its right end, as viewed in FIG. 1, and then at its left end as viewed in that figure, to prepare it for interfitting endwise connection with the right end of the stud which procedes it.

At the discharge end of the slotting machine, glue is applied to the tongues at the left hand, leading end of each stud to prepare that end for interfitted, adhesive union with the trailing slotted end of its predecessor. The studs are brought together by being fed leftward endwise in interfitted end to end relation in a following, stud uniting machine (not shown).

The final step in preparing the left hand leading slotted end of a stud for adhesive union with the slotted right hand end of a preceding stud consists in the application of glue to the fingers which are to constitute the leading end of the stud in the following, stud joining machine.

It is usual to supply the glue in liquid form from a glue pot 18 directly to a rotary applicator 20 through a distributor block 22. This is a very unsatisfactory arrangement because the glue is pumped through at an invariable speed and generally considerably faster than it is required.

As a result, an excess of glue is delivered, doing a sloppy job. The excess glue is returned to the glue pot in an open trough which corresponds in position to the pipe 24. This is an unsatisfactory arrangement for two reasons: (1) the excess glue during its return is progressively dried out and thickened, and (2) the air to which it is exposed is loaded with sawdust, which sawdust becomes a progressively concentrated pollutant in the returned glue.

In accordance with the present invention provision is made for adjusting the rate of glue supply more nearly to the actual requirements and for returning the reduced surplus glue to the glue pot through a pipe instead of the open trough. This protects the returned glue both against progressive drying out and against the progressive picking up of sawdust.

To these ends the glue applying part of the machine is modified, as will be explained. A conventional motor 26, through a shaft 28, drives a pump 29 in the glue pot 18. The pump delivers glue through a pipe system 34 to a glue distributor 36 and thence to a rotary glue applicator 38. The applicator 38 is cylindrical in form, being carried at the lower end of a driven, vertically extending shaft 40, 42. The applicator 38 is of conventional construction, being formed exteriorly with alternate circumferential ribs and grooves which are complementary to the grooves and ribs of the studs.

Figure 5:
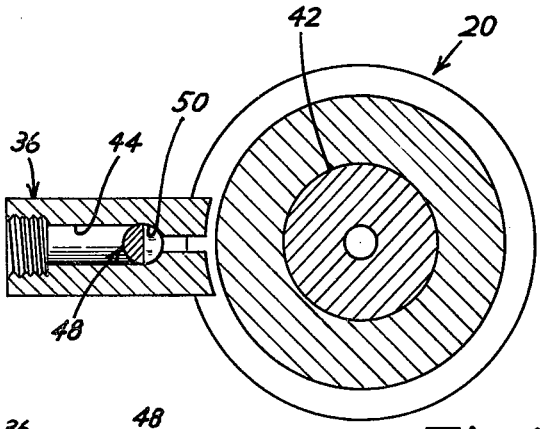
FIG. 5 is a horizontal sectional plan view taken on the line 5—5 of FIG. 3, looking in the direction of the arrows, the novel glue supply valve being shown as completely closed.
Figure 6:
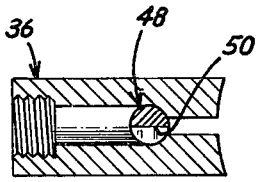
FIG. 6 is similar to FIG. 5, but it shows only the novel glue supply regulating valve, the valve being in a fully open position.
Figure 7:
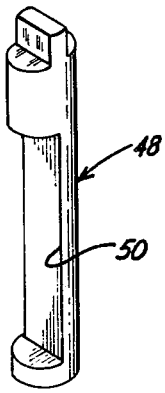
FIG. 7 is a perspective view of the glue supply valve.

A feature of significant novelty resides in the fact that the glue is delivered to the applicator through a distributor or doctor block 36, the doctor block having a horizontal glue passage 44, a cylindrical vertical glue passage 46 and a manually rotatable barrel valve 48. The valve 48 is illustrated in detail in FIG. 7. It has cylindrical portions at its lower end and near its upper end but between those portions it is half cut away, thereby providing a broad, semi-cylindrical, glue transmitting notch 50. The valve 48 can be set in a fully closed position as shown in FIG. 5, a half open position as shown in FIG. 6, a fully open position or any intermediate position as desired. In other words, the valve 48 can be set to any position desired from fully open to fully closed, serving as a means for metering the delivery of glue to the applicator at exactly the required rate or a near approximation of it.

As wear occurs between the circumferential ribs of the glue roll 20 and the doctor block 36, the valve 48 can be readjusted from time to time to provide for the optimum rate of delivery of glue to the glue roll.

Desirably the valve will be so set that the glue level will be restricted to deliver glue only to the teeth of the applicator which penetrate the work pieces.

The pump which drives the glue upward through a pipe 34 has a greater capacity than is ever actually required. Provision is accordingly made of a return line 30 and a settable valve 52 for returning surplus glue through the pipe 30 to the glue pot. Any glue which drips off of the applicator 38 is collected and returned in a clean condition to the glue pot through the pipe 24.

I have described what I believe to be the best embodiment of my invention. What I desire to cover by letters patent, however, is set forth in the appended claims.

I claim:

1. A finger slotting and glue applying machine, comprising the combination with means for feeding finger slotted studs past a glue applying station, of a rotary circumferentially ribbed glue applicator at said station rotatable about a vertical axis which is perpendicular to the direction of advance of the studs, a glue delivering doctor block having interfitting relation with said rotatable applicator at said station, a glue pot, means for pumping glue from the glue pot through the doctor block to the applicator, and a vertically extending rotary valve mounted in the doctor block, which valve is manually settable to meter the delivery of glue uniformly at various chosen rates from the doctor block to the applicator.

2. A finger slotting and glue applying machine as set forth in claim 1 which further includes tubular means for returning to the glue pot in a clean condition all furnished glue in excess of that required by the thickness of the work material.

* * * * *